US007856736B2

(12) United States Patent
Churchill et al.

(10) Patent No.: US 7,856,736 B2
(45) Date of Patent: Dec. 28, 2010

(54) DRYING APPARATUS

(75) Inventors: John Churchill, Wiltshire (GB); Peter Nigel Hutchinson, West Yorkshire (GB); Alexander Stuart Knox, Wiltshire (GB); Marcus Lee Hartley, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 341 days.

(21) Appl. No.: 12/159,367

(22) PCT Filed: Nov. 29, 2006

(86) PCT No.: PCT/GB2006/004437

§ 371 (c)(1),
(2), (4) Date: Aug. 14, 2008

(87) PCT Pub. No.: WO2007/080363

PCT Pub. Date: Jul. 19, 2007

(65) Prior Publication Data

US 2008/0313919 A1 Dec. 25, 2008

(30) Foreign Application Priority Data

Jan. 12, 2006 (GB) ..... 0600536.7

(51) Int. Cl.
*F26B 19/00* (2006.01)

(52) U.S. Cl. ..... 34/90; 34/202

(58) Field of Classification Search ..... 34/90, 34/201, 202, 218

See application file for complete search history.

(56) References Cited

U.S. PATENT DOCUMENTS

| | | | |
|---|---|---|---|
| 5,459,944 | A | 10/1995 | Tatsutani et al. |
| 6,018,885 | A | 2/2000 | Hill |
| 6,769,197 | B1 | 8/2004 | Tai |

FOREIGN PATENT DOCUMENTS

| | | | |
|---|---|---|---|
| AU | 2005-203363 | A1 | 2/2006 |
| CZ | 15 805 | U1 | 11/2005 |
| EP | 0 211 418 | | 2/1987 |

(Continued)

OTHER PUBLICATIONS

GB Search Report, dated May 17, 2006, directed to corresponding GB Application No. GB0600536.7. 1 page.

International Search Report, mailed May 15, 2007, directed to corresponding International Application No. PCT/GB2006/004437.7 pages.

*Primary Examiner*—Jiping Lu
(74) *Attorney, Agent, or Firm*—Morrison & Foerster LLP

(57) ABSTRACT

A drying apparatus includes an outer case, a portion of the outer case defining a cavity in which articles can be dried and an outlet disposed at the lower end of the cavity. A removable liquid treatment module is arranged downstream of the outlet and within the outer case, the liquid treatment module including a liquid dispersal unit. By providing a liquid treatment module that is removable, the liquid treatment module can be easily and quickly replaced by an unskilled user without undue burden. The invention is particularly suitable for use in a hand dryer.

13 Claims, 5 Drawing Sheets

FOREIGN PATENT DOCUMENTS

| | | | | |
|---|---|---|---|---|
| JP | 07280419 | A | * | 10/1995 |
| JP | 10281627 | A | * | 10/1998 |
| JP | 11-18999 | | | 1/1999 |
| JP | 2000-157447 | A | | 6/2000 |
| JP | 2002-34844 | A | | 2/2002 |
| JP | 2002-345681 | A | | 12/2002 |
| JP | 2003-275129 | | | 9/2003 |

* cited by examiner

DRYING APPARATUS

REFERENCE TO RELATED APPLICATIONS

This application is a national stage application under 35 USC 371 of International Application No. PCT/GB06/004437, filed Nov. 29, 2006, which claims the priority of United Kingdom Application No. 0600536.7, filed Jan. 12, 2006, the contents of both of which prior applications are incorporated herein by reference.

FIELD OF THE INVENTION

The present invention relates to drying apparatus. Particularly, but not exclusively, the invention relates to drying apparatus including a liquid treatment module for collecting, treating and disposing of a waste liquid such as water.

BACKGROUND OF THE INVENTION

Conventional arrangements for collecting and removing waste water from drying apparatus such as hand dryers are well known from, for example, U.S. Pat. No. 5,459,944. Waste water is collected via a duct or similar and transferred to a drip collector for subsequent manual removal. Such storage of waste water is unhygienic, may lead to the spread of bacteria and requires regular maintenance to empty the drip collector and maintain a sanitary environment.

The addition of an antibacterial water absorption sheet with a large surface area to encourage evaporation is known from JP 11-18999 A. This counters some of the problems of bacterial infestation and results in less frequent emptying of a water collector. However, waste water is still present in the hand dryer for longer than is desirable, and maintenance is still required.

An alternative arrangement involves the evaporation of the waste water through use of a thermal source. This can also be used in conjunction with a stream of air. These techniques are known from JP 2002-345681A. The use of electrical components often means that, when these components require maintenance or replacement, the machine will have to be repaired by a trained engineer. This is time consuming and results in the machine being out of action for a significant period of time. This is inconvenient and potentially costly for the consumer.

SUMMARY OF THE INVENTION

It is an object of the present invention to provide drying apparatus which is capable of collecting and dispersing liquid and which, in use, can be maintained more quickly and easily than prior art apparatus.

The invention provides drying apparatus comprising an outer case, a portion of the outer case defining a cavity in which articles can be dried, an outlet disposed at the lower end of the cavity and a liquid treatment module arranged downstream of the outlet, the liquid treatment module being removable from the drying apparatus and including a liquid dispersal unit, wherein the drying apparatus further comprises a chamber for removably receiving the liquid treatment module, electrical connectors being provided within the chamber and on the liquid treatment module to connect electrically the liquid treatment module to the drying apparatus, the electrical connectors forming electrical connections when the liquid treatment module is received in the chamber.

By providing a liquid treatment module that is removable as a unit, the drying apparatus can be maintained easily and quickly by an unskilled user without undue burden. This allows the liquid treatment module to be installed easily in the drying apparatus and electrical connections to be made automatically as the liquid treatment module is inserted into the chamber. Further, any electronic components included in the liquid treatment module can be replaced easily by an unskilled person simply by replacing the liquid treatment module.

Preferably, the electrical connectors are located so as to be inaccessible to a user when the liquid treatment module is removed from the drying apparatus. This prevents any danger of injury to a user which may be present if a live electrical connector were accessible when the liquid treatment module is removed.

BRIEF DESCRIPTION OF THE DRAWINGS

An embodiment of the invention will now be described with reference to the accompanying drawings, in which.

DETAILED DESCRIPTION OF THE INVENTION

Figure 1B:
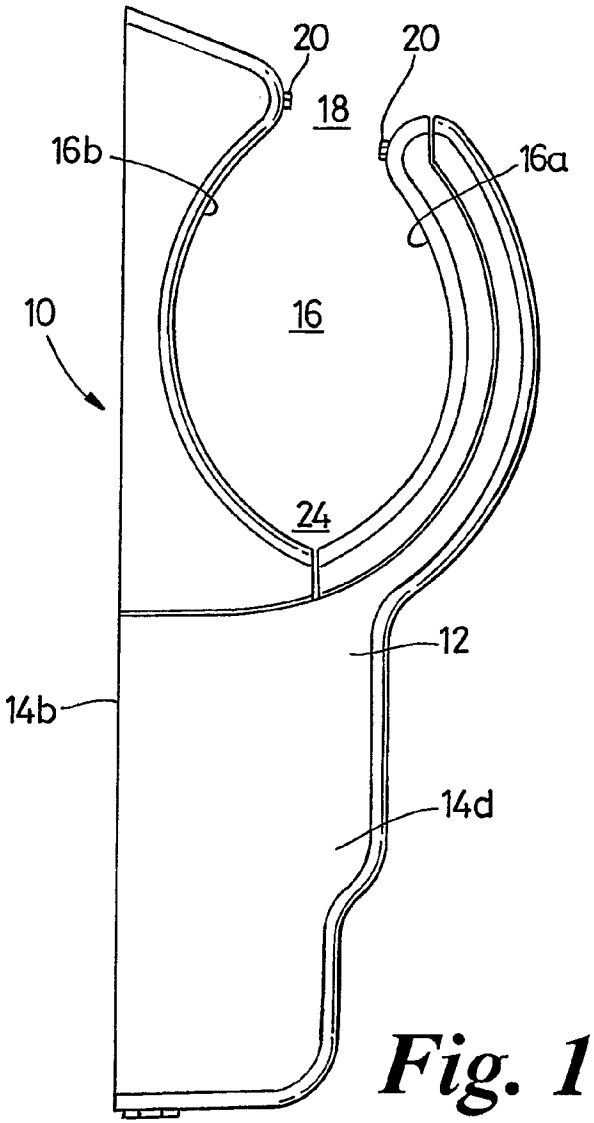
FIG. 1*b* is a side view of the hand dryer of FIG. 1*a;*
Figure 1A:
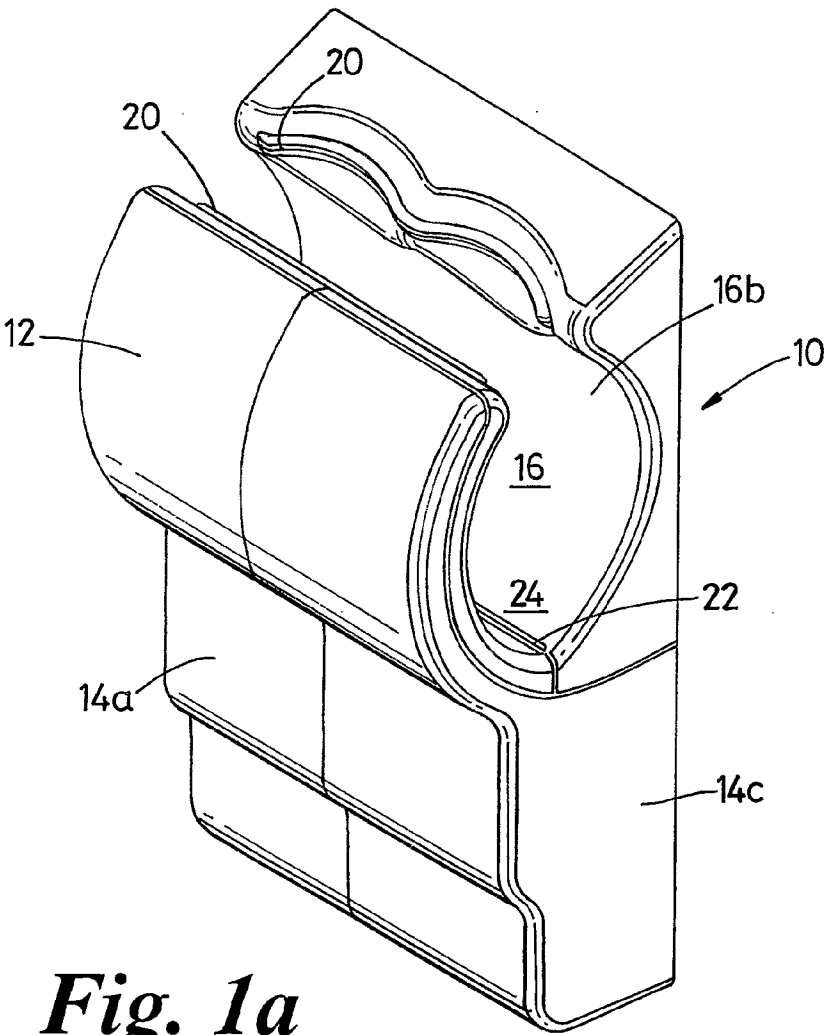
FIG. 1*a* is a perspective view of a hand dryer according to the present invention.

FIGS. 1*a* and 1*b* show a hand dryer 10 according to the present invention. The hand dryer 10 includes an outer case 12, a front wall 14*a*, a rear wall 14*b*, two side walls 14*c*, 14*d* and a cavity 16. The rear wall 14*b* may include elements suitable for attaching the hand dryer 10 to a wall surface or other suitable fixture. Elements for connecting the hand dryer 10 to a power source may also be included.

The cavity 16 is defined by opposing arcuate front and rear walls 16*a*, 16*b*. The cavity 16 is open at its upper end 18, and the dimensions of the opening are sufficient to allow a user's hands (not shown) to be inserted easily into the cavity 16 for drying. A high-speed airflow is generated by a motor unit having a fan (not shown). The motor unit and fan are located inside the outer case 12. The high-speed airflow is expelled through two slot-like openings 20 disposed at the upper end 18 of the cavity 16 to dry the user's hands. These features are not material to the present invention and will not be described any further here. The cavity 16 is open at the sides as can be seen in FIGS. 1*a* and 1*b*.

Figure 2:
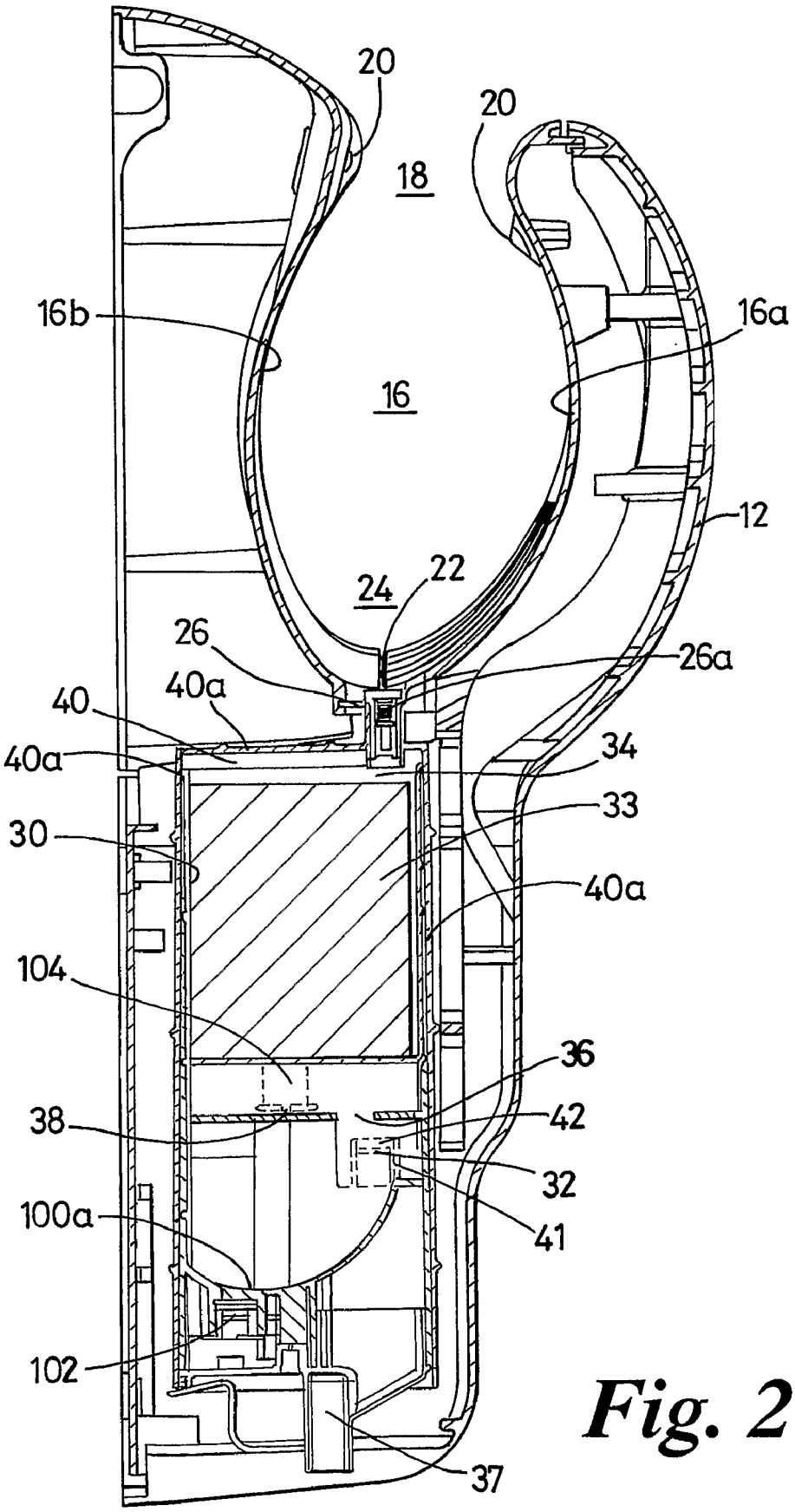
FIG. 2 is a section through the hand dryer of FIG. 1*a;*

As can be seen from FIG. 2, a drain channel 22 is located at the lower end 24 of the cavity 16. The drain channel 22 is delimited by the lower edges of the front wall 16*a* and the rear wall 16*b* of the cavity 16 and slopes downwardly towards one side of the cavity 16. An outlet 26 is located in the drain channel 22. The outlet 26 can take any suitable form. In this embodiment, it comprises a circular aperture with a central plug 26*a*. The outlet 26 and plug 26*a* delimit a narrow, annular opening.

Figure 3:
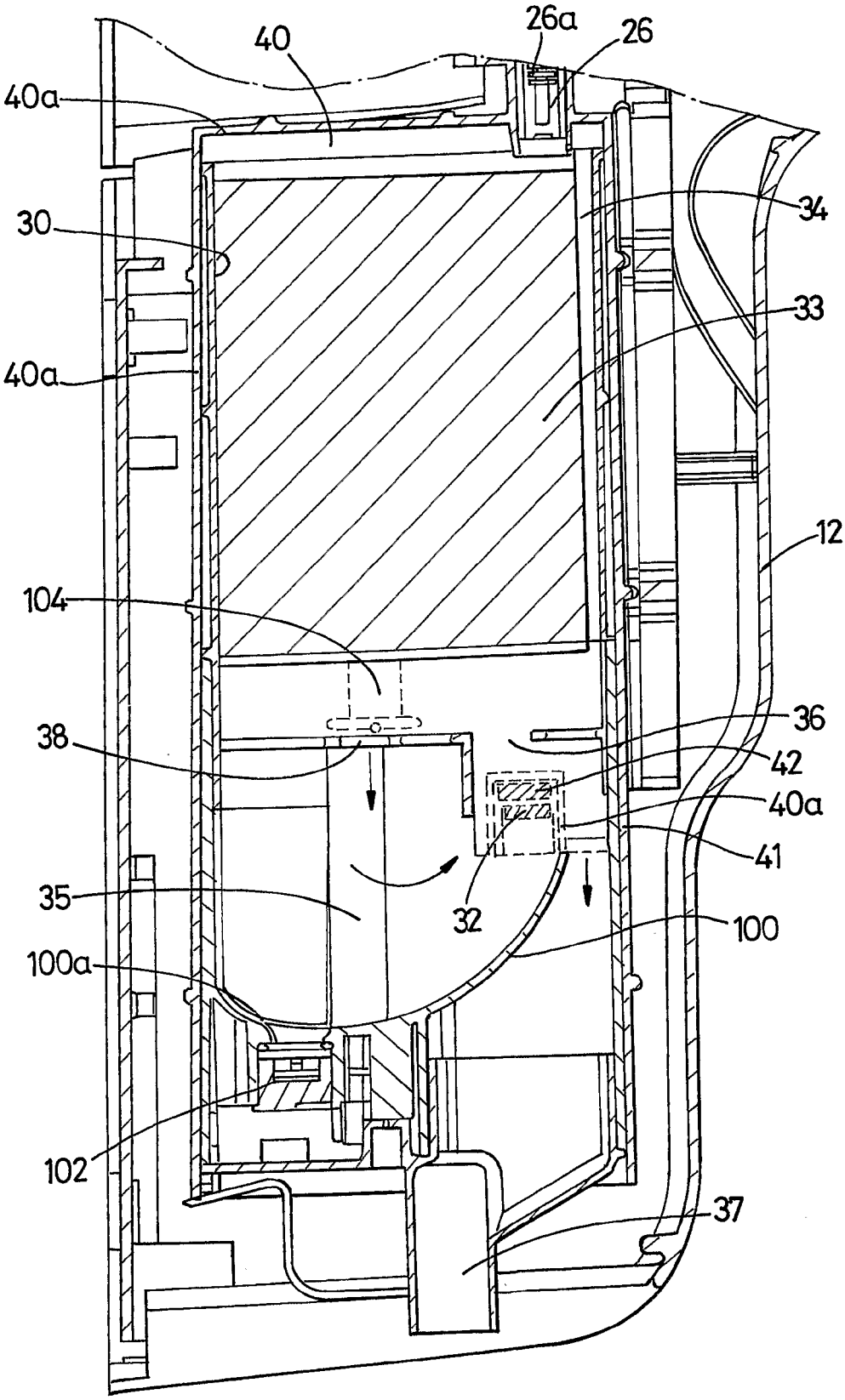
FIG. 3 is an enlarged version of part of FIG. 2 showing the internal workings of the hand dryer in greater detail.

Referring to FIGS. 2 and 3, a chamber 40 is formed in a lower part of the outer case 12 below the cavity 16. The chamber 40 is delimited by a plurality of chamber walls 40*a* and has an open lower end. A liquid treatment module 30 is located in the chamber 40 and is held in place by clips, quarter turn fastenings or other fastening means (not shown).

Figure 4:
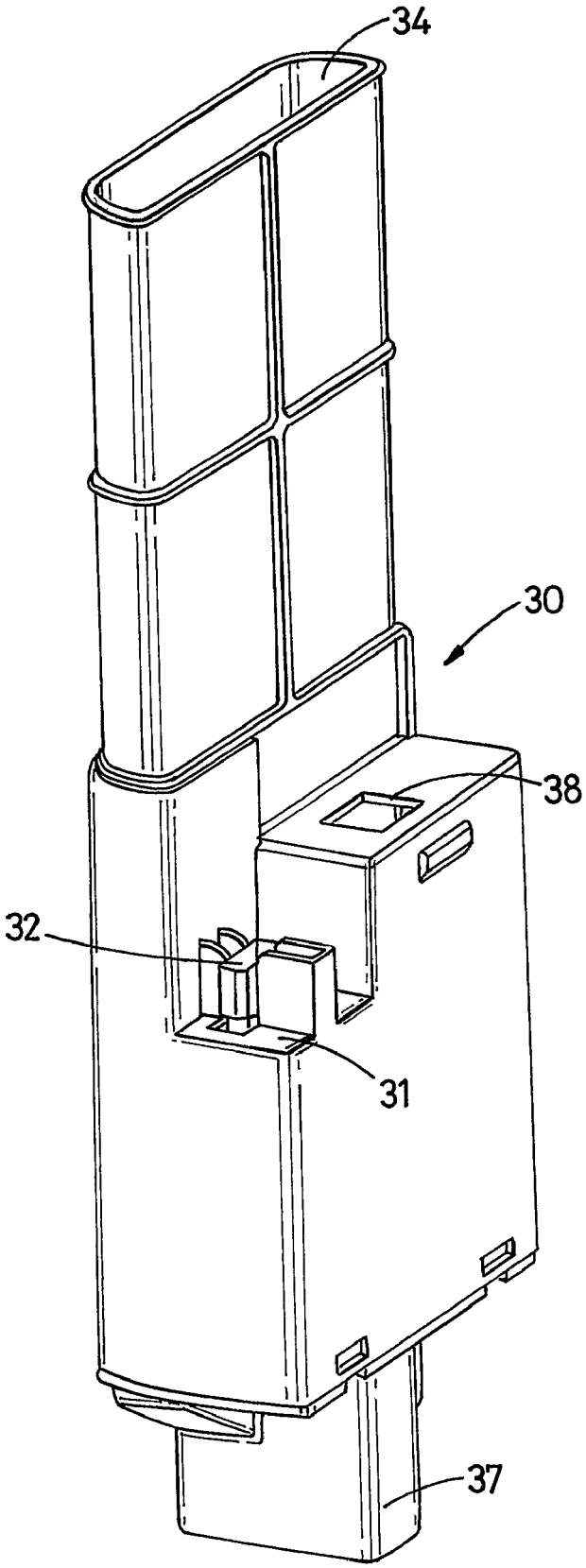
FIG. 4 is a perspective view of the liquid treatment module removed from the hand dryer of FIG. 1*a;*

Referring to FIGS. 3 and 4, the liquid treatment module 30 includes a filter 33 located in a passageway 34. The passageway 34 has an open upper end which communicates with the outlet 26 when the liquid treatment module 30 is located in the chamber 40.

The filter 33 is designed to filter particulates and impurities from the water, and to kill bacteria in the water. The filter 33 includes a ceramic material impregnated with an iodine-containing resin. The ceramic material has pores of a specific size to remove unwanted impurities and particulates. The iodine-containing resin acts as a sterilising compound to kill any bacteria present in the water.

The liquid treatment module 30 further includes a liquid dispersion unit 35 located below the filter 33. An opening 36 is located at the lower end of the passageway 34 and allows water to flow into the liquid dispersion unit 35. An exhaust conduit 37 located within the liquid dispersion unit 35 provides a communication path from the liquid dispersion unit 35 to the outside of the outer case 12 of the hand dryer 10. The liquid dispersion unit 35 further includes a collector 100 for collecting water from the outlet 26. The collector 100 has a base 100*a*. A high frequency agitator in the form of a piezo-electric device 102 is located at the base 100*a*. A fan 104 is supported on one of the chamber walls 40*a*. The fan 104 is located outside the chamber 40 separate from the liquid treatment module 30. The fan 104 is configured to direct an airflow into the collector 100 through an aperture 38 provided in the liquid treatment module 30.

Figure 5B:
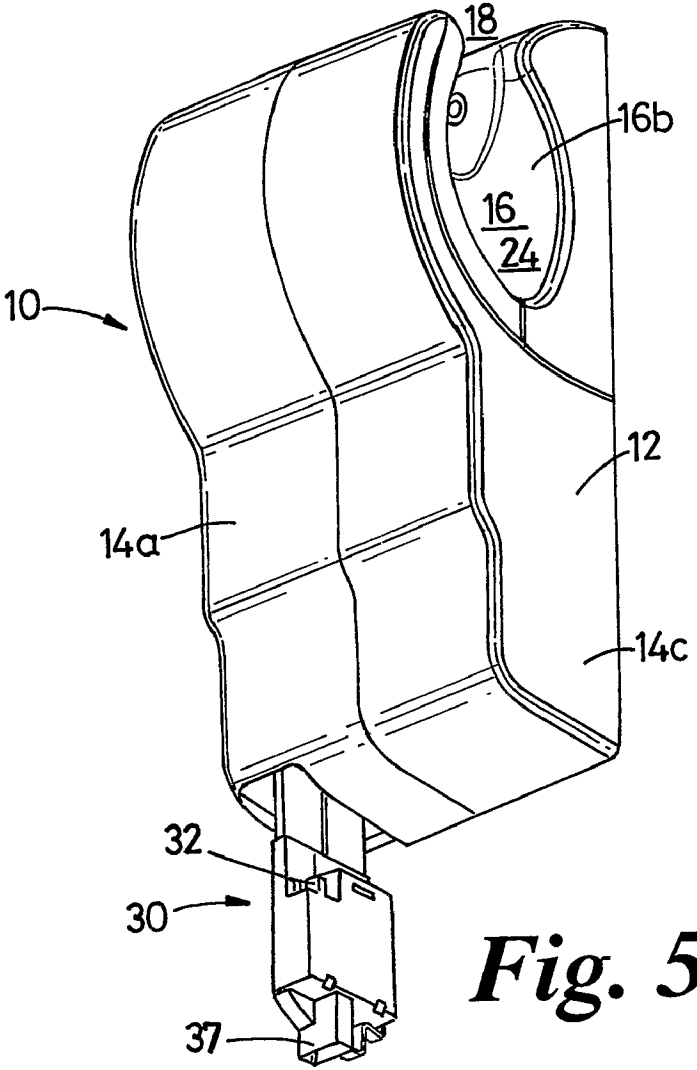
FIG. 5*b* is a perspective view from below of the hand dryer of FIG. 1*a* showing the liquid treatment module partially removed from the hand dryer.
Figure 5A:
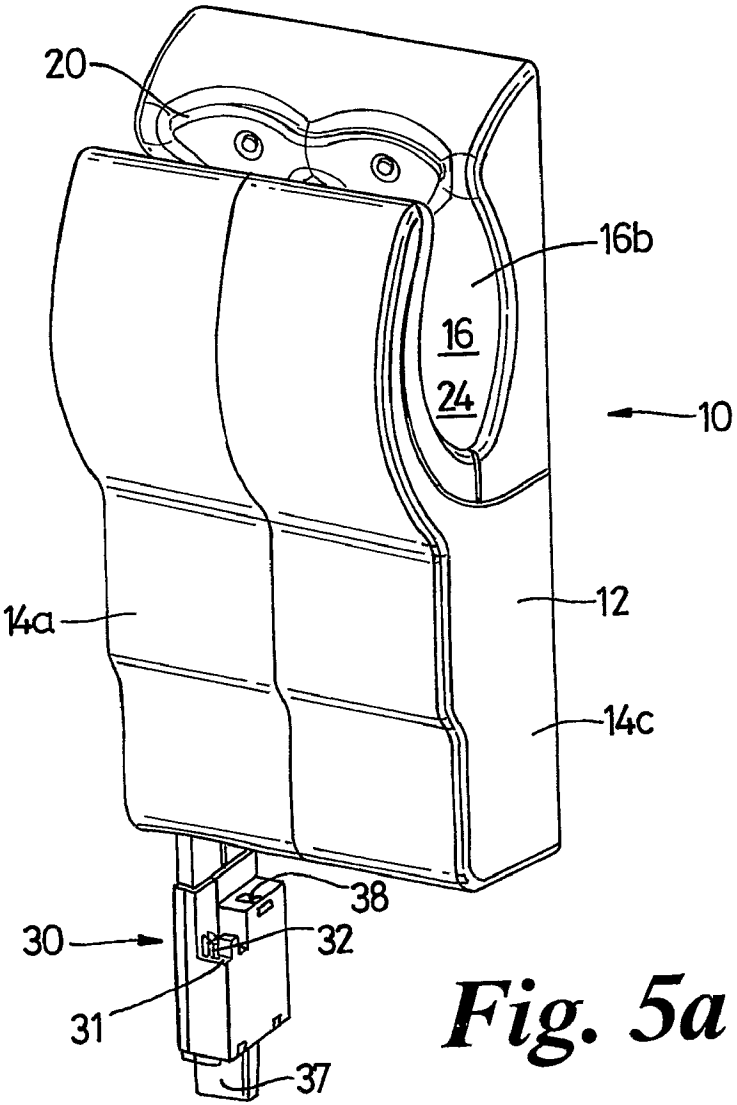
FIG. 5*a* is perspective view from above of the hand dryer of FIG. 1*a* showing the liquid treatment module partially removed from the hand dryer.

Referring to FIGS. 4 and 5*a*, electrical connectors 32 are located on an upward facing surface 31 of the liquid treatment module 30. The electrical connectors 32 project upwardly from the upward facing surface 31 towards the upper end of the liquid treatment module 30. When the liquid treatment module 30 is located in the chamber 40, the electrical connectors 32 are received by a guide 41 which is mounted on one of the side walls 40*a* of the chamber 40. Electrical connectors 42 are located at the upper end of the guide 41. The width and length of the guide 41 and the position of the electrical connectors 42 are selected such that the electrical connectors 42 are inaccessible to probing fingers. When the liquid treatment module 30 is located inside the chamber 40 (as shown in FIGS. 2 and 3), the electrical connectors 32 are in contact with the electrical connectors 42 in order to supply power to the liquid treatment module 30.

In use, the water removed from a user's hands during the drying process flows down the front wall 16*a* and the rear wall 16*b* of the cavity 16 and into the drain channel 22 disposed at the lower end 24 of the cavity 16. The drain channel 22 collects and guides the water towards the outlet 26.

Upon entering the outlet 26, the water passes into the passageway 34, through the filter 33 and into the collector 100 through the opening 36. The ceramic compound in the filter 33 removes impurities and particulates from the water in order to clean it. Further, the iodine-impregnated resin within the filter 33 sterilises the water by killing any bacteria in the water. The cleaned and sterilised water collects at the base 100*a* of the collector 100 which is in communication with the piezo-electric device 102. The piezo-electric device 102 is set to oscillate at a pre-determined frequency and magnitude such that sufficient vibrational energy is imparted to water molecules on the surface of the water in the collector 100 to overcome surface tension effects. Therefore, the water is turned into a fine mist in the interior space of the collector 100.

The fan 104 directs an airflow downwardly into the collector 100. This directs the fine mist towards, and down, the exhaust conduit 37 which leads to the outside of the outer case 12. This process continues until all the water contained within the collector 100 is efficiently and hygienically removed from the collector 100.

FIGS. 5*a* and 5*b* illustrate the removal of the liquid treatment module 30 from the outer case 12 for maintenance or replacement. The liquid treatment module 30 is removed downwardly from the hand dryer 10. When this is done, the electrical connectors 32, 42 are disconnected before the liquid treatment module 30 has been fully removed. This reduces the risk of an electric shock. Further, the electrical connectors 42 are positioned and/or arranged so that they are not accessible to a user when the liquid treatment module 30 is removed from the chamber 40.

A replacement liquid treatment module 30 can be inserted upwardly into the chamber 40. When this is done, the electrical connectors 32 are received by the guide 41 located inside the chamber 40. When the liquid treatment module 30 is located in the chamber 40, the electrical connectors 32 automatically come into contact with the electrical connectors 42 located in the chamber 40 and power can then be supplied to the liquid treatment module 30.

The present invention allows the hand dryer 10 to be maintained easily. The liquid treatment module 30 can be removed simply and quickly from the hand dryer 10 by an unskilled user, and a replacement module inserted should replacement be required. This is of benefit to a consumer because the liquid treatment module 30 contains electronic components which, if they fail, could result in a significant period of downtime whilst a skilled engineer is called. However, the removable nature of the liquid treatment module 30 enables it to be replaced so that the hand dryer 10 can be returned to use quickly.

It will be understood that the invention is not to be limited to the precise details described above. Other variations and modifications will be apparent to the skilled reader.

For example, the drying apparatus need not take the form of a hand dryer. The drying apparatus could be a condenser-type laundry dryer. In such a laundry dryer, water evaporated from wet textiles in the drum (cavity) of the laundry dryer can be condensed and then collected in a liquid treatment module to be removed by agitation or evaporation. Should maintenance or replacement be required, the liquid treatment module can be removed from the laundry dryer.

Further, the invention could be utilized in other forms of drying apparatus; for example, other forms of domestic or commercial drying apparatus such as washer-dryers, ventilation-type laundry dryers or full-length body dryers.

Additionally, other forms of liquid dispersion unit can be used to disperse the collected liquid; for example, an ultrasonic generator, a fan, a heating element or electrolysing apparatus. Any of these devices could be used in place of a piezo-electric device to agitate, evaporate or electrolyse the water (or other liquid) as required.

The liquid treatment module need not be located inside a chamber present in the drying apparatus. Other arrangements are possible; for example, the module could form a part of the outer case, or could be mounted on or outside the outer case of the drying apparatus.

Further, the liquid treatment module need not be removed from the lower part of the drying apparatus. The liquid treatment module may form part of the upper side or top of the drying apparatus, and be removed sideways or upwardly depending upon the requirements of the drying apparatus.

As a further variation, other forms of airflow generator are possible. For example, an air bleed or exhaust airflow could be taken from a motor unit. For example, the motor unit for driving the drying process of the hand dryer has a fan. This fan could be used to generate an airflow to vent the evaporated water to the outside of the drying apparatus rather than using an additional fan.

Additionally, the filter need not be a ceramic filter impregnated with an iodine-containing resin. Other types of filter media could be used; for example, glass-fibre or plastic brushes. Further, the filter could be impregnated with alternative bacteria-killing media; for example, Titanium dioxide or UV-radiation activated silver nanoparticles. Alternatively, the particulate-filtering media and the bacteria-killing media may form separate stages in the filter and do not need to be combined.

As a further variation, the filter need not be removable from the drying apparatus. The filter could remain inside the casing of the drying apparatus when the liquid treatment module is removed. The filter could either be removable separately from the liquid treatment module or be fixed permanently inside the casing of the drying apparatus.

The invention claimed is:

1. A drying apparatus comprising:

an outer case, a portion of the outer case defining a cavity in which articles can be dried, an outlet disposed at the lower end of the cavity, a liquid treatment module arranged downstream of the outlet, the liquid treatment module being removable from the drying apparatus and including a liquid dispersal unit, and a chamber for removably receiving the liquid treatment module, electrical connectors being provided within the chamber and on the liquid treatment module to connect electrically the liquid treatment module to the drying apparatus, the electrical connectors forming electrical connections when the liquid treatment module is received in the chamber.

2. The drying apparatus according to claim 1, wherein the chamber is located within the outer case of the drying apparatus.

3. The drying apparatus according to claim 1 or 2, wherein the electrical connections are located so as to be inaccessible to a user when the liquid treatment module is removed from the drying apparatus.

4. The drying apparatus according to claim 1 or 2, wherein the electrical connectors within the chamber between the drying apparatus and the liquid treatment module are broken when the liquid treatment module is removed from the chamber.

5. The drying apparatus according to claim 1 or 2, wherein the liquid dispersal unit comprises a collector for collecting liquid and an evaporation unit in communication with the collector for evaporating liquid collected therein.

6. The drying apparatus according to claim 5, wherein the evaporation unit is a high frequency agitator.

7. The drying apparatus according to claim 5, wherein the evaporation unit comprises a heat source.

8. The drying apparatus according to claim 1 or 2, wherein the liquid treatment module further comprises a filtration unit.

9. The drying apparatus according to claim 8, wherein the filtration unit includes at least one ceramic filter.

10. The drying apparatus according to claim 8, wherein the filtration unit includes a sterilising compound.

11. The drying apparatus according to claim 1 or 2, wherein the drying apparatus is a hand dryer and the cavity is dimensioned to receive a user's hands.

12. The drying apparatus according to claim 1 or 2, wherein the drying apparatus is a laundry dryer and the cavity is dimensioned to receive textiles.

13. The drying apparatus according to claim 3, wherein the electrical connectors within the chamber between the drying apparatus and the liquid treatment module are broken when the liquid treatment module is removed from the chamber.

* * * * *